US006841929B2

(12) United States Patent
Ishimoto et al.

(10) Patent No.: US 6,841,929 B2
(45) Date of Patent: Jan. 11, 2005

(54) DISPLAY DEVICE WITH A PLURALITY OF LIGHT-EMITTING TUBES ARRANGED IN PARALLEL

(75) Inventors: Manabu Ishimoto, Kawasaki (JP); Tsutae Shinoda, Kawasaki (JP); Akira Tokai, Kawasaki (JP); Hitoshi Yamada, Kawasaki (JP); Kenji Awamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 11 days.

(21) Appl. No.: 10/428,101

(22) Filed: May 2, 2003

(65) Prior Publication Data

US 2003/0214223 A1 Nov. 20, 2003

(30) Foreign Application Priority Data

May 14, 2002 (JP) ..... 2002-138709

(51) Int. Cl.[7] ..... H01J 1/62
(52) U.S. Cl. ..... 313/485; 313/493; 313/634
(58) Field of Search ..... 313/483, 484, 313/485, 493, 634

(56) References Cited

U.S. PATENT DOCUMENTS

| | | | | |
|---|---|---|---|---|
| 3,927,342 | A | 12/1975 | Bode et al. | 313/188 |
| 2002/0030437 | A1 * | 3/2002 | Shimizu et al. | 313/495 |
| 2003/0048068 | A1 * | 3/2003 | Yamada et al. | 313/485 |

FOREIGN PATENT DOCUMENTS

| | | |
|---|---|---|
| EP | 1294007 A2 | 3/2003 |
| EP | 1298695 A2 | 4/2003 |
| JP | 2000-315460 | 11/2000 |

* cited by examiner

*Primary Examiner*—Vip Patel
(74) *Attorney, Agent, or Firm*—Staas & Halsey LLP

(57) ABSTRACT

A display device includes a plurality of light-emitting tubes arranged in parallel consisting of narrow tubes having a plurality of light-emitting points formed in a longitudinal direction thereof, a phosphor layer provided to the inside of each of the narrow tubes, and a discharge gas sealed into each of the narrow tubes. The plurality of light-emitting tubes are arranged in accordance with their property previously measured.

27 Claims, 7 Drawing Sheets

DISPLAY DEVICE WITH A PLURALITY OF LIGHT-EMITTING TUBES ARRANGED IN PARALLEL

CROSS-REFERENCE TO RELATED APPLICATION

This application is related to Japanese Patent Application JP2002-138709 filed on May 14, 2002, whose priority is claimed under 35 USC § 119, the disclosure of which is incorporated by reference in its entirety.

BACKGROUND OF THE INVENTION

1. Field of the Invention

The present invention relates to a display device in which a plurality of light-emitting tubes (also referred to as "a plasma light-emitting tube", "a display tube", "a gas discharge tube", "a plasma discharge tube" and the like) are arranged in parallel to each other. More particularly, it relates to a display device constructed by arranging a plurality of light-emitting tubes in parallel comprising narrow tubes of a diameter of about 0.5 to 5 mm each having a phosphor layer provided and a discharge gas sealed inside for displaying optional images.

2. Description of the Related Art

A display device described in, for example, Japanese Unexamined Patent Publication No. 2000-315460 is well known as the above display device. In the display device, for obtaining a number of light-emitting points in a longitudinal direction of a light-emitting tube, a plurality of display electrode pairs are arranged on a substrate which supports the tubes, in a direction crossing the longitudinal direction of the tubes, an electrode forming face of the substrate is contacted with the tubes and voltage is applied to the plurality of the display electrode pairs.

However, in such a display device, it is difficult to manufacture light-emitting tubes having the same shape and performance, and the luminance (light-emitting luminance) of the tubes is not uniform due to variations caused when the tubes are manufactured. Thereby, when the light-emitting tubes are arranged in parallel to each other, non-uniformity of the luminance leads to irregular display of the display device.

Further, since the diameter of the light-emitting tubes is not microscopically uniform, areas where the display electrode pair formed on the substrate is in contact with each of the tubes are non-uniform. Therefore, variations of driving voltage will be caused by the non-uniformity described above, which leads to light-emission failures of the light-emitting points.

SUMMARY OF THE INVENTION

The present invention has been achieved in view of the above-mentioned problem. For manufacturing the display device with a plurality of light-emitting tubes arranged in parallel to each other as described above, an object of the present invention is to previously measure a property such as luminance, discharge threshold voltage, dimension of external diameter or the like of the light-emitting tubes, and arrange the tubes in accordance with the property, thereby to prevent irregular display of the display device and variations of driving voltage.

The present invention provides a display device comprising: a plurality of light-emitting tubes arranged in parallel consisting of narrow tubes having a plurality of light-emitting points formed in a longitudinal direction thereof; a phosphor layer provided to the inside of each of the narrow tubes; and a discharge gas sealed into each of the narrow tubes, wherein the plurality of light-emitting tubes are arranged in accordance with their property previously measured.

According to the present invention, the plurality of light-emitting tubes are arranged depending on their property which is previously measured for each tube. Therefore, for example, irregular display is prohibited if the tubes are arranged in accordance with the luminance, stability of display is achieved if the tubes are arranged in accordance with the discharge threshold voltage and light-emission failures of the tubes are prevented if the tubes are arranged in accordance with the dimension of external diameter.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
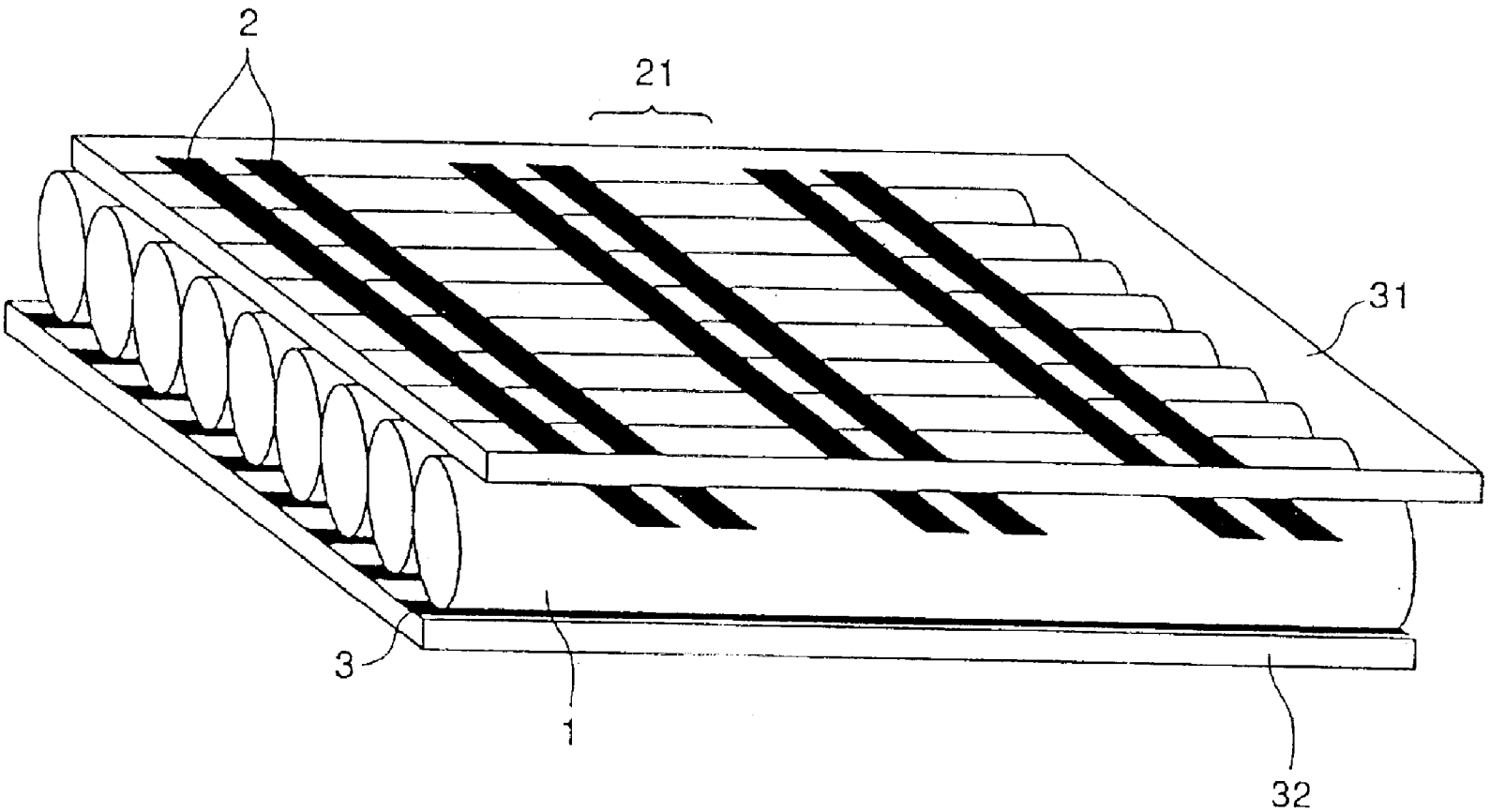
FIG. 1 is an exemplary view illustrating a general construction of a display device according to the present invention.

In the present invention, the light-emitting tubes may be composed of narrow tubes each having a phosphor layer provided, a discharge gas sealed inside, and a number of light-emitting points formed in a longitudinal direction thereof. Various kinds of light-emitting tubes known in the field of art are applicable to the light-emitting tube of the present invention. A narrow tube of any diameter may be used for manufacturing the light-emitting tube, but specifically a narrow tube having a diameter of about 0.5 to 5 mm is preferred. The narrow tube preferably has a circular cross section, but it may have a flat elliptic cross section.

In the present invention, a plurality of light-emitting tubes are arranged corresponding to their property previously measured for each tube. The property of the light-emitting tubes signify, for example, luminance, discharge threshold voltage (discharge firing voltage or minimum sustain discharge voltage), dimension of external diameter or the like. The discharge firing voltage signifies a voltage necessary for generating discharge between two electrodes in a non-residual charge state. The minimum sustain discharge voltage means a minimum voltage necessary for alternately generating a sustain discharge (referred to as "display discharge" and so on) between two electrodes by alternating current in a residual charge state. However, since there is a relationship between the discharge firing voltage and the minimum sustain discharge voltage, either of the two voltages can be measured, and regarded as the discharge threshold voltage.

Desirably, the above construction further provides a pair of substrates on a display side and a rear side of the display device for sandwiching the plurality of light-emitting tubes arranged in parallel. For example, glass, resins or the like is applicable to the substrates.

In the case where the pair of the substrates is provided for sandwiching the plurality of light-emitting tubes as described above, it is desirable that a plurality of electrodes are arranged on a surface of the substrate on the display device facing the tubes in a direction crossing a longitudinal direction of the tubes.

In the above construction, when the plurality of light-emitting tubes are arranged in accordance with the luminance, it is desired that a light-emitting tube having a higher luminance is arranged at the center of the display device and light-emitting tubes having a lower luminance is arranged at the ends thereof.

Also, when the plurality of the tubes are arranged in accordance with discharge threshold voltage, a tube having a lower discharge threshold voltage is desirably arranged at the center of the display device and tubes having a higher discharge threshold voltages is desirably arranged at the ends thereof.

Further, when the plurality of tubes are arranged in accordance with their dimension of external diameter, it is desirable to arrange the tubes in the order of dimension of external diameter. In this case, the tubes may be arranged in either one of increasing or decreasing order of dimension of external diameter from one end of the display device to the other end thereof. Alternatively, a light-emitting tube having a large dimension of external diameter may be arranged at the center of the display device and the other tubes may be arranged so that the dimension of external diameter becomes symmetrically and sequentially smaller toward left and right ends thereof. Conversely, a light-emitting tube having a small dimension of external diameter may be arranged at the center of the display device and the other tubes may be arranged so that the dimension of external diameter becomes symmetrically and sequentially larger toward left and right ends thereof.

In the case where the light-emitting tubes are arranged in accordance with either one the above properties, it is desired that the tubes are arranged in parallel to each other so as to vary smoothly their property.

Hereinafter, the present invention will be described in detail based on embodiments shown in the drawings. The present invention is not limited to the embodiments but can be variously modified.

FIG. 1 is an exemplary view illustrating a general construction of a display device according to the present invention.

A display device of the present invention is constructed by arranging a plurality of light-emitting tubes in parallel to each other comprising narrow tubes of a diameter of about 0.5 to 5 mm each having a phosphor layer provided and a discharge gas sealed inside for displaying optical images.

In the drawing, reference numeral 31 indicates a front (display side) substrate, 32 a rear substrate, 1 a light-emitting tube, 2 a display electrode pair (a main electrode pair), and 3 a data electrode (a signal electrode).

The front substrate 31 and the rear substrate 32 are formed of acrylic resin. The light-emitting tube 1 is formed of borosilicate glass. The display electrode pairs are formed on a surface of the front substrate 31 opposite to the light-emitting tubes by printing or vapor deposition of copper, chromium, silver or the like. Similarly, the data electrodes 3 are formed on a surface of the rear substrate 32 opposite to the light-emitting tubes by printing or vapor deposition of copper, chromium, silver or the like.

Inside the light-emitting tube (within a discharge space), a phosphor layer (not shown) is inserted, a discharge gas is introduced, and both ends of the tube are sealed. As described above, the data electrodes 3 are formed on the rear substrate 32 and provided so as to be in contact with the tubes 1 along a longitudinal direction of the tubes 1. The display electrode pairs 2 are formed on the front substrate 31 and provided so as to be in contact with the tubes 1 in a direction crossing the data electrodes 3. Non-discharge regions (Non-discharge gaps) 21 are provided between adjacent display electrode pairs 2.

In assembly of the display device, the data electrodes 3 and the display electrode pairs 2 are closely contacted with an outer periphery of the tube 1 at lower and upper sides, respectively. An adhesive may be interposed between the display electrode 2 and the outer periphery of the tube 1 for improving the contact therebetween.

An area where the data electrode 3 intersects the display electrode pair 2 is a unit luminous area when the display device is viewed in plan. Display is performed by using, as a scanning electrode, either one electrode of the display electrode pair 2, generating a selection discharge at the area where the scanning electrode intersects the data electrode 3, thereby selecting a luminous area, utilizing a wall charge provided, in accordance with the selection discharge, within the tube in the luminous area and generating display discharges between the display electrode pair 2. The selection discharge is an opposite discharge generated within the tube 1 between the scanning electrode and the data electrode 3 opposed to each other vertically. The display discharge is a surface discharge generated within the tube 1 between the display electrode pair 2 disposed in parallel on a plane.

In view of these electrode arrangements, a number of light-emitting points are formed in a longitudinal direction of the tubes 1.

In the construction of the electrodes shown in the drawing, three electrodes are arranged at one luminous area and display discharges are generated between the display electrode pair 2, but the manner of generating display discharges is not limited thereto, and display discharges may be generated between the display electrode 2 and data electrode 3.

In other words, such a construction may be achieved that the display electrode pair 2 is used as one electrode and the display electrode 2 is used as a scanning electrode to generate selection discharges and display discharges (opposite discharges) between the display electrode 2 and the data electrode 3.

Figure 2:
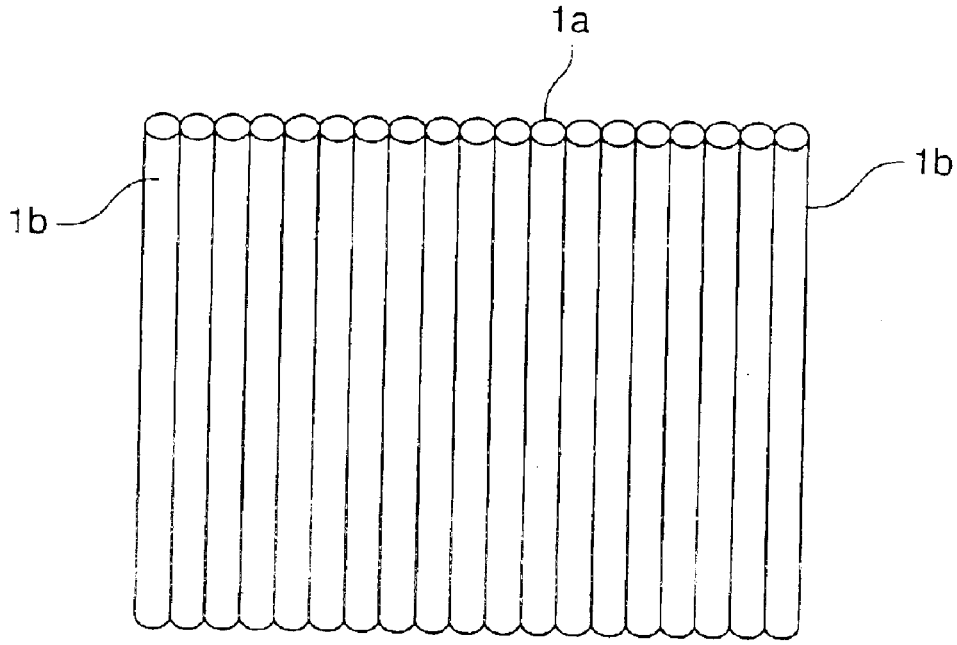
FIG. 2 is an exemplary view illustrating the construction of a display device of Embodiment 1.

FIG. 2 is an exemplary view illustrating the construction of a display device of Embodiment 1. The figure shows a cross-sectional view of the display device.

In the present embodiment, a light-emitting tube, having a circular cross section, is formed of Pyrex® glass (a heat-resisting glass manufactured by Corning Inc. in U.S.A.) or the like to have an external diameter of 1 mm, a wall thickness of 100 $\mu$m and a length of 400 mm.

The tube 1 is obtained by manufacturing a base material similar to and larger than the tube 1 by Danner process and extending the base material while softening it by heating.

In the present embodiment, the plurality of light-emitting tubes are arranged in accordance with their luminance. In other words, a light-emitting tube 1*a* having a higher luminance is arranged at the center of the screen and tubes 1*b* having a lower luminance are arranged at left and right ends of the screen. The tubes have their own luminances determined in manufacture. Therefore, the luminances are previously measured and then the tubes are arranged.

Figure 3:
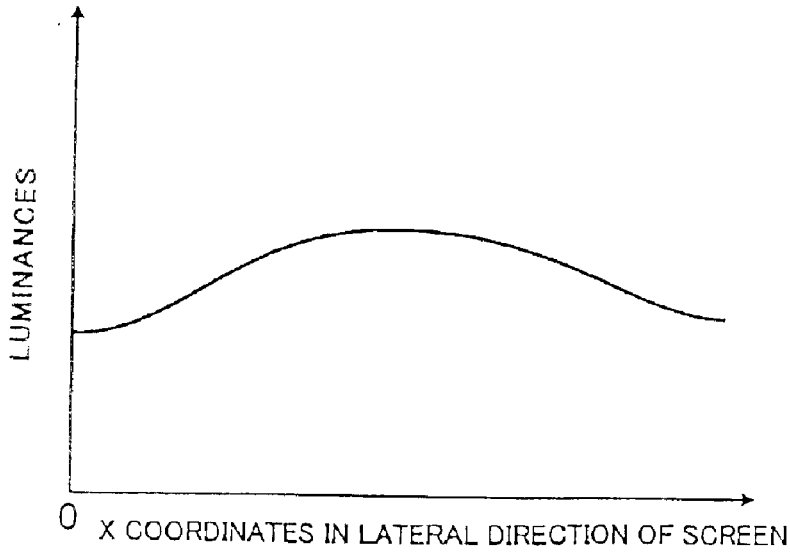
FIG. 3 is a graph showing a relationship between the positions of light-emitting tubes and their luminances with plotted x coordinates.

FIG. 3 is a graph showing a relationship between the positions of light-emitting tubes and their luminances with plotted x coordinates.

As shown in the graph, the tubes are arranged in the order of luminance so that the luminance draws a gentle curve, i.e., the luminance varies smoothly. Specifically, the tube 1*a* having a higher luminance is arranged at the center of the screen, the tubes 1*b* having a lower luminance are arranged at left and right ends of the screen. Tubes having a middle luminance are arranged between the center of the screen and both ends thereof.

Figure 4:
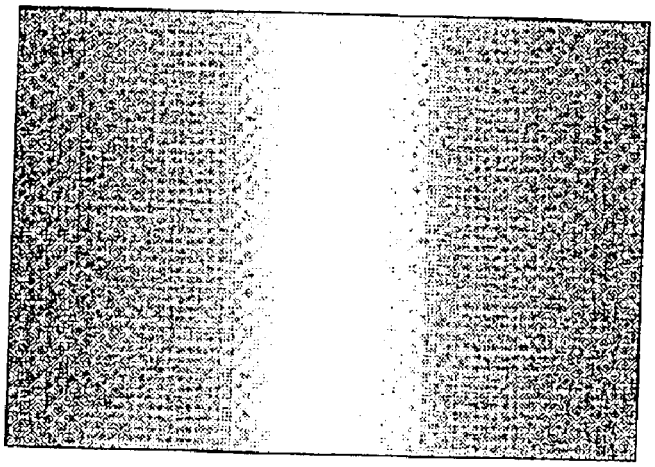
FIG. 4 is an exemplary view illustrating a display example of the whole screen of the display device which is displayed in white according to Embodiment 1.

FIG. 4 is an exemplary view illustrating a display example of the whole screen of the display device which is displayed in white according to Embodiment 1. In the case where the tubes 1 are arranged as illustrated in the graph of FIG. 3, it is possible to heighten the luminance at the center of the screen and lower the luminance at both ends thereof as shown in FIG. 4.

Figure 5:
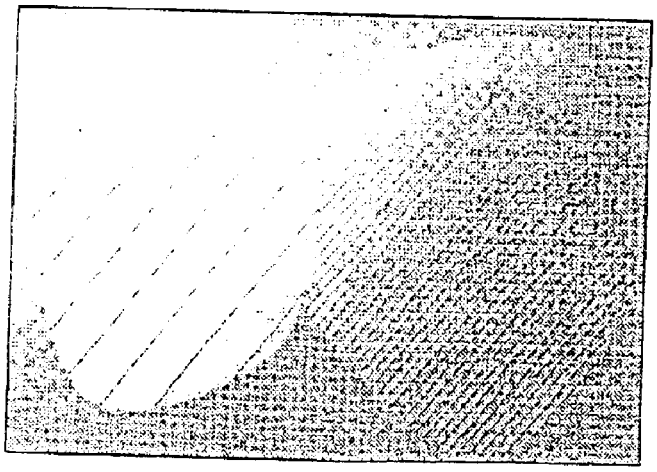
FIG. 5 is an exemplary view showing a comparative example of arrangement of the light-emitting tubes in accordance with luminance.

FIG. 5 is an exemplary view showing a comparative example of arrangement of the light-emitting tubes in accordance with luminance. If the tubes 1 are randomly arranged without consideration of luminance, luminance irregularities are generated at random on the whole screen.

As understood from the above comparison, when the tube having a higher luminance is arranged at the center of the display device and the tubes having a lower luminance are arranged at the ends thereof according to the present embodiment, a high luminance area is placed at the center of the screen, thereby it is possible to display images more naturally.

Figure 6:
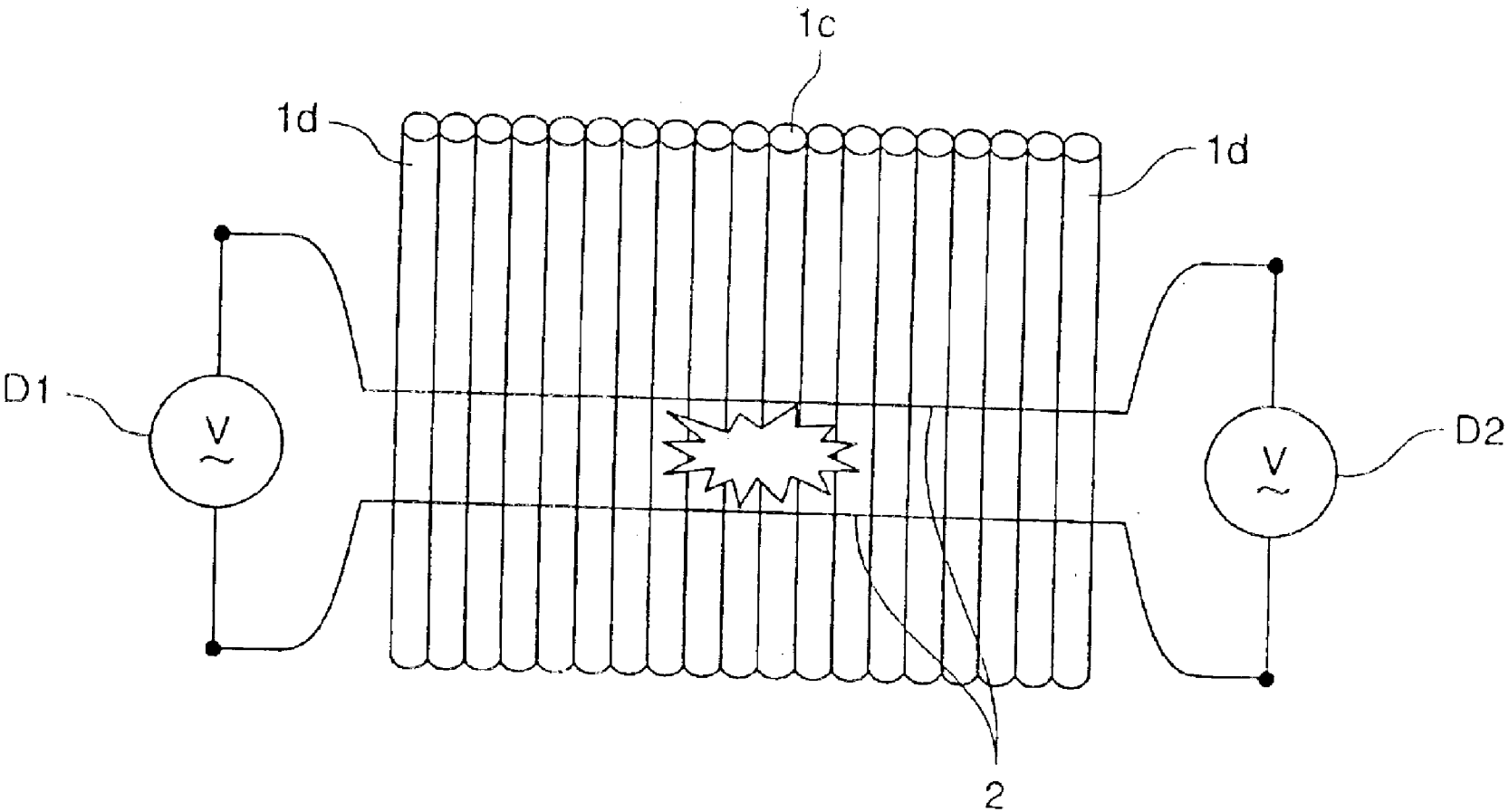
FIG. 6 is an exemplary view illustrating the construction of a display device according to Embodiment 2.

FIG. 6 is an exemplary view illustrating the construction of a display device according to Embodiment 2. According to the present embodiment, a plurality of light-emitting tubes are arranged in accordance with discharge threshold voltage. Namely, a tube 1*c* having a low discharge threshold voltage is arranged at the center of the screen and tubes 1*d* having a high discharge threshold voltage are arranged at left and right ends thereof. The tubes have their own discharge threshold voltages determined in manufacture. Therefore, the discharge threshold voltages are previously measured and then the tubes are arranged.

The discharge threshold voltage means a discharge firing voltage or a minimum sustain discharge voltage when an alternating voltage V is applied between the display electrode pair 2 by drivers D1 and D2. As mentioned above, the discharge firing voltage means a voltage necessary for generating a discharge between the display electrode pair 2 in a non-residual charge state. The minimum sustain discharge voltage means a minimum voltage necessary for generating a sustain discharge between the display electrode pair 2 in a residual charge state by alternating current.

In one light-emitting tube, there is a relationship between the discharge firing voltage and the minimum sustain discharge voltage. That is, if the tube has a high discharge firing voltage, the minimum sustain discharge voltage is also high, and if the tube has a low discharge firing voltage, the minimum sustain discharge voltage is also low. Thus, in the present embodiment, the discharge firing voltage is measured, and regarded as the discharge threshold voltage.

Figure 7:
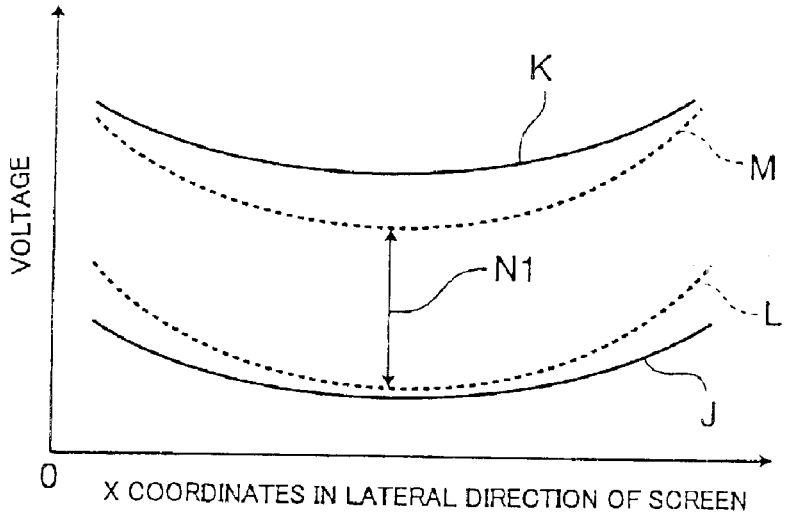
FIG. 7 is a graph showing a relationship between the positions of light-emitting tubes and their discharge threshold voltages with plotted x coordinates.

FIG. 7 is a graph showing a relationship between the positions of light-emitting tubes and their discharge threshold voltages with plotted x coordinates.

In the graph, a solid line J signifies a minimum sustain discharge voltage of the tube and a solid line K a discharge firing voltage thereof. As shown in the graph, the tubes are arranged in the order of discharge firing voltage so that the tube having a low discharge firing voltage is arranged at the center of the screen. A width from the minimum sustain discharge voltage to the discharge firing voltage is substantially the same for all of the tubes.

Dotted lines L and M show a minimum value and a maximum value of the sustain discharge voltage to be actually applied, respectively. A range of the sustain discharge voltage from the dotted line L to M signifies a voltage margin (a range of the voltage capable of driving the display device) N1. At the center of the screen where the display electrode pair is distant from the drivers, voltage drop occurs. The maximum value of the sustain discharge voltage is lower than the discharge firing voltage. That is because if the sustain discharge voltage exceeds the discharge firing voltage, light is emitted even at light-emitting points where discharges are unnecessary to be generated. For this reason, the range of the sustain discharge voltage between the dotted lines L and M means the voltage margin N1.

Figure 8:
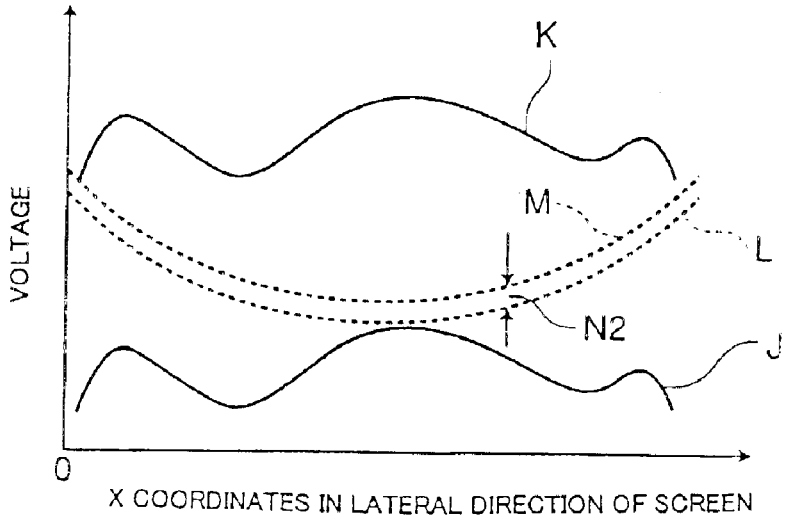
FIG. 8 is a graph illustrating a comparative example of arrangement of the light-emitting tubes in accordance with discharge threshold voltage.

FIG. 8 is a graph illustrating a comparative example of arrangement of the light-emitting tubes in accordance with discharge threshold voltage.

The solid line J indicates the minimum sustain discharge voltage of the tube and the solid line K indicates the discharge firing voltage thereof. The graph shows an example in the case where the tubes 1 are randomly arranged regardless of the discharge threshold voltage. In this way, the random arrangement of the tubes 1 will cause variations of the discharge threshold voltage of the tubes 1 on the whole screen.

The dotted lines L and M illustrate the minimum value and the maximum value of the sustain discharge voltage to be actually applied, respectively, when the tubes 1 are arranged at random. As shown in the graph, a voltage margin N2 signifies a range of the sustain discharge voltage from the dotted line L to M in the case where the tubes are arranged without consideration of the discharge threshold voltage.

Thereby, the display device is forced to be driven within an extremely narrow range of the voltage, which will cause an increase of costs of drivers and light-emission failures of light-emitting points.

On the other hand, as shown in FIG. 6, the tube 1*c* having a lower discharge threshold voltage is arranged at the center of the screen and the tubes 1*d* having a higher discharge threshold voltage are arranged at both ends of the screen. In this case, the voltage margin N1 of the sustain discharge voltage is allowed to be wider than N2 of the comparative example, in view of the voltage drop. Thereby, the display device can be driven within a wide range of the sustain discharge voltage. For this reason, it is possible to reduce an increase of costs of drivers and prevent light-emission failures of light-emitting points.

Figure 9:
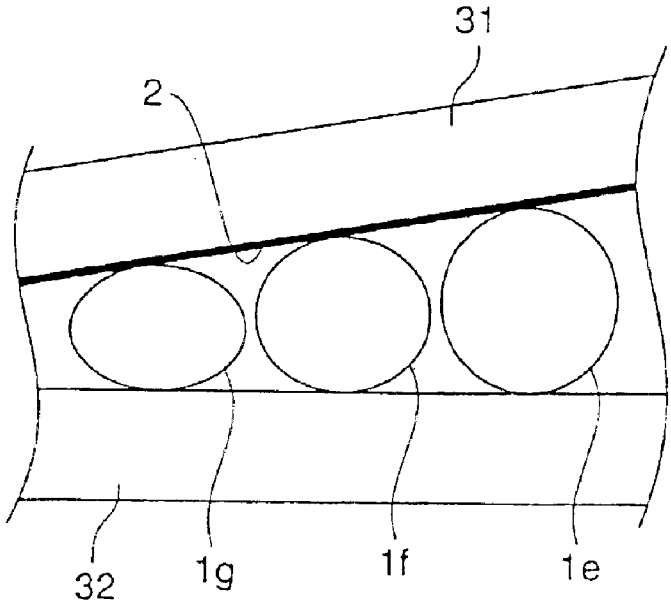
FIG. 9 is an exemplary view illustrating the construction of a display device according to Embodiment 3.

FIG. 9 is an exemplary view showing the construction of a display device according to Embodiment 3. This figure illustrates a section of the display device crossing at a right angle a longitudinal direction of the light-emitting tubes. In the present embodiment, the tubes are arranged in accordance with the dimension of external diameter.

In other words, a tube 1*e* having a large dimension of external diameter is arranged at one end (e.g., a right end) of the screen, a tube 1*f* having a middle dimension of external diameter is successively arranged at the center thereof and a tube 1*g* having a small dimension of external diameter is arranged at the other end (e.g., a left end) thereof. The tubes have their own dimensions of external diameter determined in manufacture. Therefore, the dimensions of external diameter are previously measured and then the tubes are arranged.

When the tubes are arranged in the order of dimension of external diameter as described above, contact areas between the display electrode pair 2 formed on the front substrate 31 and each of the tubes 1*e*, 1*f* and 1*g* can be uniform even if the front substrate 31 is, for example, an acrylic and stiff substrate. Therefore, it is possible to prevent variations of a driving voltage, luminance irregularities and light-emission failures of light-emitting points.

Figure 10:
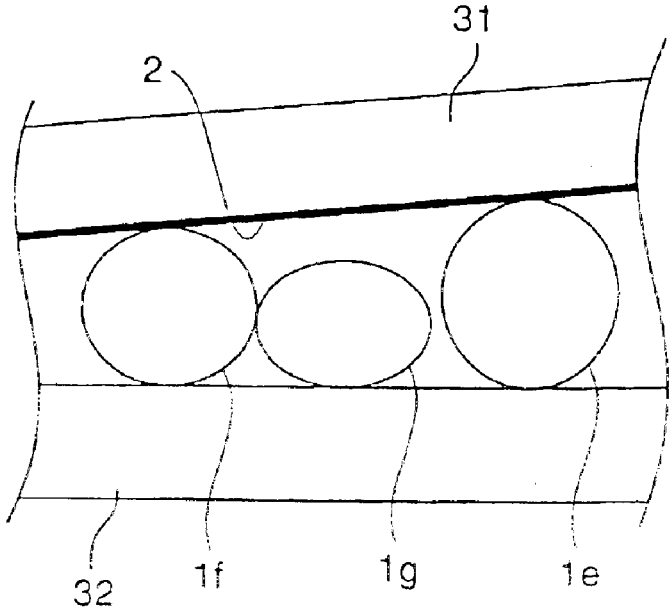
FIG. 10 is an exemplary view showing a comparative example without consideration of a dimension of external diameter of the light-emitting tubes.

FIG. 10 is an exemplary view illustrating a comparative example without consideration of the dimension of external diameter of the light-emitting tubes. Where the tubes 1*e*, 1*f* and 1*g* are randomly arranged irrespective of the dimension of external diameter thereof, the tube 1*g* may not be in contact with the display electrode pair 2, which will cause variations of driving voltage, luminance irregularities and light-emission failures of light-emitting points.

Figure 11:
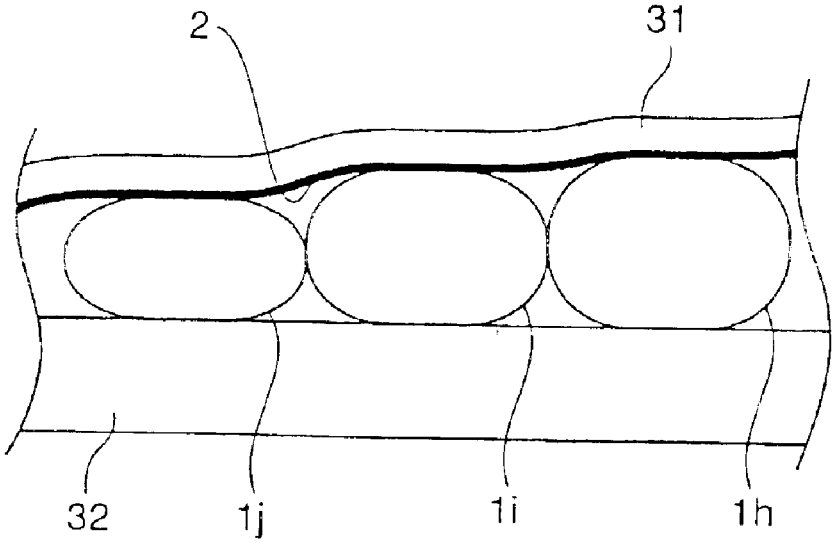
FIG. 11 is an exemplary view illustrating the construction of a display device according to Embodiment 4.

FIG. 11 is an exemplary view illustrating the construction of a display device according to Embodiment 4. This figure shows a section of the display device crossing at a right angle a longitudinal direction of the light-emitting tubes. In the present embodiment, the tubes have an oblate spheroidal section and are arranged in accordance with the dimension of external diameter.

In the same manner as in Embodiment 3, a tube 1*h* having a large dimension of external diameter is arranged at one end (e.g., a right end) of the screen, a tube 1*i* having a middle dimension of external diameter is successively arranged at the center thereof and a tube 1*j* having a small dimension of external diameter is arranged at the other end (e.g., a left end) thereof. The tubes have their own dimensions of external diameter determined in manufacture. Therefore, the dimensions of external diameter are previously measured and then the tubes are arranged.

When the tubes are arranged in the order of dimension of external diameter as described above, contact areas between the display electrode pair 2 formed on the front substrate 31 and each of the tubes 1*h*, 1*i* and 1*j* can be uniform even if the front substrate 31 is a film substrate such as a flexible PET substrate, etc. Thus, it is possible to prevent variations of driving voltage and realize uniform display of the screen without luminance irregularities and variations of driving voltage.

Figure 12:
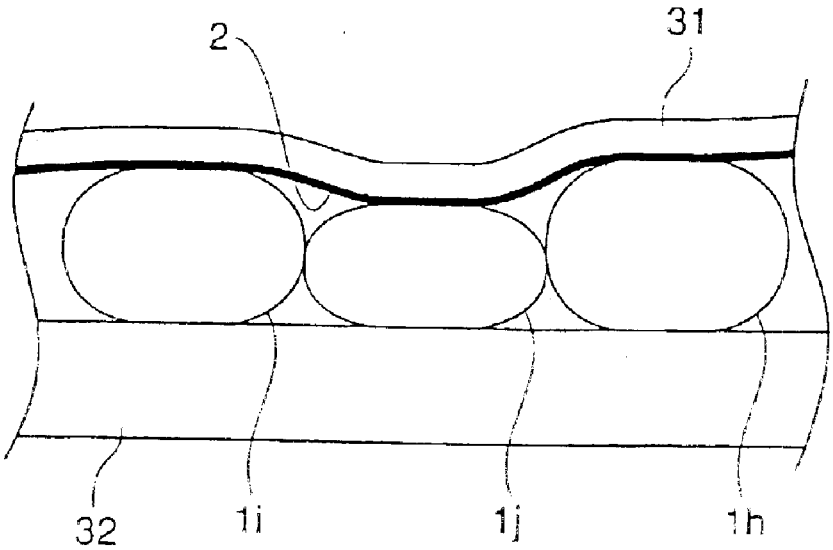
FIG. 12 is an exemplary view illustrating a comparative example without consideration of a dimension of external diameter of the light-emitting tubes.

FIG. 12 is an exemplary view illustrating a comparative example without consideration of the dimension of external diameter of the light-emitting tubes and a comparative example by use of the light-emitting tubes having an oblate spheroidal section. Where the tubes 1*h*, 1*i* and 1*j* are arranged at random without consideration of the dimension of external diameter, a contact area between the tube 1*j* having the small dimension of external diameter and the display electrode pair 2 becomes narrow by tension of the substrate 31 which in this case is a film substrate. For this reason, variations of driving voltage on the whole screen, luminance irregularities and driving voltage irregularities will be caused.

As mentioned in the foregoing, for manufacturing the display device in which the plurality of light-emitting tubes are arranged in parallel to each other, the light-emitting tubes are arranged in accordance with their property such as the luminance, the discharge threshold voltage, the dimension of external diameter or the like which is previously measured for each tube, so that display irregularities and variations of driving voltage of the display device can be prevented and display quality of the tubes can be improved.

According to the present invention, the plurality of light-emitting tubes are arranged in accordance with their property which is previously determined. For example, in the case where the tubes are arranged in accordance with the luminance, display irregularities can be prohibited. In the case where the tubes are arranged in accordance with the discharge threshold voltage, stable display can be realized by assuring a margin of the driving voltage, and in the case where the tubes are arranged in accordance with the dimension of external diameter, it is possible to prevent the light-emission failures of the light-emitting points.

What is claimed is:

1. A display device comprising:

a plurality of light-emitting tubes arranged in parallel, the light-emitting tubes being narrow tubes each having a plurality of light-emitting points formed in a longitudinal direction thereof, each light emitting tube having a measured property;

a phosphor layer provided to the inside of each of the narrow tubes; and a discharge gas sealed into each of the narrow tubes, wherein the plurality of light-emitting tubes are arranged with respect to each other in accordance with their relative values of the measured property.

2. The display device according to claim 1, wherein a pair of substrates is further provided on a display side and a rear side of the display device for sandwiching the plurality of light-emitting tubes arranged in parallel.

3. The display device according to claim 2, wherein a plurality of electrodes are further arranged on a surface of the substrate on the display side facing the tubes in a direction crossing a longitudinal direction of the tubes.

4. The display device according to claim 1, wherein the measured property of the tubes is luminance.

5. The display device according to claim 4, wherein a respective tube having a higher luminance is arranged at the center of the display device and tubes having a lower luminance than said respective tube are arranged at ends of the display device.

6. The display device according to claim 1, wherein the measured property of the tubes is discharge threshold voltage.

7. The display device according to claim 6, wherein a respective tube having a lower discharge threshold voltage is arranged at the center of the display device and tubes having a higher discharge threshold voltage than the respective tube are arranged at ends of the display device.

8. The display device according to claim 1, wherein the measured property of the tubes is dimension of external diameter.

9. The display device according to claim 8, wherein the tubes are arranged in order of the dimension of external diameter.

10. The display device according to claim 1, wherein the tubes are so arranged that the measured property varies smoothly.

11. The display device according to claim 4, wherein the tubes are so arranged that the measured property varies smoothly.

12. The display device according to claim 6, wherein the tubes are so arranged that the measured property varies smoothly.

13. The display device according to claim 8, wherein the tubes are so arranged that the measured property varies smoothly.

14. A display device comprising:

light-emitting tubes arranged in parallel, each tube having a phosphor layer inside of the respective tube and a discharge gas sealed in the respective tube, wherein each tube has a corresponding measured property and the tubes are arranged with respect to each other in the display device in accordance with their relative values of the measured property.

15. The display device according to claim 14, further comprising:

a first substrate provided on a display side of the display device; and a second substrate provided on a rear side of the display device, the first and second substrates together sandwiching the tubes.

16. The display device according to claim 15, further comprising:

a plurality of electrodes on a surface of the first substrate facing the tubes, the plurality of electrodes extending in a direction crossing a longitudinal direction of the tubes.

17. The display device according to claim 14, wherein the measured property is luminance.

18. The display device according to claim 17, wherein a respective tube having a higher luminance is arranged at a center of the display device and tubes having a lower luminance than said respective tube are arranged at ends of the display device.

19. The display device according to claim 14, wherein the measured property is discharge threshold voltage.

20. The display device according to claim 19, wherein a respective tube having a lower discharge threshold voltage is arranged at a center of the display device and tubes having a higher discharge threshold voltage than the respective tube are arranged at ends of the display device.

21. The display device according to claim 14, wherein the measured property is dimension of external diameter.

22. The display device according to claim 21, wherein the tubes are arranged in order of the dimension of external diameter.

23. The display device according to claim 14, wherein the tubes are arranged so that the measured property varies smoothly.

24. The display device according to claim 17, wherein the tubes are arranged so that the measured property varies smoothly.

25. The display device according to claim 19, wherein the tubes are arranged so that the measured property varies smoothly.

26. The display device according to claim 21, wherein the tubes are arranged so that the measured property varies smoothly.

27. A display device comprising:

light-emitting tubes arranged in parallel, each tube having a phosphor layer inside of the respective tube and a discharge gas sealed in the respective tube, each tube having a corresponding measured property; and means for arranging the tubes with respect to each other in the display device in accordance with their relative values of the measured property.

* * * * *